US005094170A

United States Patent [19]

Raynaud et al.

[11] Patent Number: 5,094,170

[45] Date of Patent: Mar. 10, 1992

[54] MISSILE FOR DROPPING ARMAMENTS EQUIPPED WITH A MODIFIABLE CONTAINER

[75] Inventors: Jacques Raynaud, Savigny-Sur-Orge; Pascal Herquel, Clamart, both of France

[73] Assignee: Aerospatiale Societe Nationale Industrielle, Paris, France

[21] Appl. No.: 583,562

[22] Filed: Sep. 17, 1990

[30] Foreign Application Priority Data

Sep. 29, 1989 [FR] France ..... 89 12767

[51] Int. Cl.[5] ..... F42B 12/60

[52] U.S. Cl. ..... 102/489

[58] Field of Search ..... 102/489, 351, 393

[56] References Cited

U.S. PATENT DOCUMENTS

| | | | |
|---|---|---|---|
| 2,395,913 | 3/1946 | Schultz | 89/1.5 |
| 2,434,162 | 1/1948 | Imber | 102/393 |
| 3,965,611 | 6/1976 | Pippin | 46/74 |
| 4,455,943 | 6/1984 | Pinson | 102/489 |
| 4,625,646 | 12/1986 | Pinson | 102/489 |

FOREIGN PATENT DOCUMENTS

| | | |
|---|---|---|
| 0297992 | 1/1989 | European Pat. Off. . |
| 2156974 | 9/1979 | Fed. Rep. of Germany . |
| 3500163 | 4/1986 | Fed. Rep. of Germany . |
| 2200500 | 4/1974 | France . |
| 2555731 | 5/1985 | France . |
| 1588114 | 4/1981 | United Kingdom . |
| 2204388 | 11/1988 | United Kingdom . |

OTHER PUBLICATIONS

2386 Wehrtechnik, vol. 15 (1983) Feb. No. 2, Bonn. Deutschland.

*Primary Examiner*—Michael J. Carone
*Attorney, Agent, or Firm*—Finnegan, Henderson, Farabow, Garrett & Dunner

[57] ABSTRACT

A missile for dropping a batch of armaments having a housing containing propulsion, guidance and control devices and a container having a device therein for holding and ejecting at least one armament group connected to the housing to form the missile. The container has an upper, reinforced flank, two side flanks integral with the upper flank with each having pyrotechnic cords for cutting windows therein, a lower pallet integral with the two side flanks and a pyrotechnic cord for cutting a window therein, and two end frames, the holding and ejecting device being supported on the lower pallet.

9 Claims, 4 Drawing Sheets

MISSILE FOR DROPPING ARMAMENTS EQUIPPED WITH A MODIFIABLE CONTAINER

This invention relates to the carrying, conditioning and dropping of armaments or ammunition from a carrying vehicle, such as a missile. The latter can itself be carried by an aircraft and can be launched from the latter.

This type of vehicle enables aircraft and in general terms other craft with personnel on board, to overfly enemy territory or lines and to jettison or drop armaments or ammunition onto targets. Such vehicles are in particular intended to be launched from an aircraft and can carry armaments appropriate for a given mission to the targets in question. Such vehicles are mainly constituted by a carrying vehicle and an ammunition container. The function of the latter vehicle is to carry the ammunition container to the targets in question. The function of the container is to carry and drop the ammunition. The ammunition types increase in variety as a function of the large numbers of different missions. At present, an ammunition or armament container is specifically designed for a single ammunition or armament type, a new type being defined for each new mission.

This specificity of each container type for each ammunition type has hitherto led with respect to each type to a design study of the complete container, tests on the complete craft with respect to the structural behaviour, the equivalent radar surface, etc. Each container type requires a specific fabrication and storage.

Therefore there is no container which can simultaneously carry several different ammunition types. Moreover, the prior art container does not participate in the overall bending and torsional strength of the missile, which causes serious structural performance problems.

With a view to obviating the aforementioned disadvantages, the present invention proposes an armament dropping missile for which the container can be modified in such a way as to allow different ammunition types to be carried with a minimum number of specific fittings and with easy realization.

The invention therefore relates to a missile for dropping an ammunition batch comprising propulsion and guidance/control means, as well as a modifiable container incorporating means for holding and ejecting the ammunition, so as to ensure the holding, transportation and ejection of at least one ammunition group, whilst participating in the overall strength of the missile.

According to the invention, the modifiable container constitutes the missile body and is mainly constituted by an upper, reinforced flank, two lateral flanks integral with the upper flank and each having means for cutting side windows, a lower pallet integral with the two lateral flanks and having means for cutting a lower window and supporting the holding and ejection means, two container end frames and a connection interface of the container to the missile.

The lower pallet, the window cutting means and the two end frames are standard elements, no matter what ammunition or armament types are carried. This makes it possible to arrange the composition of the ammunition batch to be carried on the lower pallet with the aid of the holding and ejection means and to then fix the same to the side flanks.

The missile preferably comprises at least one intermediate frame for subdividing the container into at least two different compartments.

In the container according to the invention, the holding and ejection means are constituted by support panniers fixed to the lower pallet, setting pads or blocks, holding straps and pyrotechnically controlled ejection bellows.

In its preferred construction, the connection interface comprises a connector for supplying the different elements of the containers with electric power, a mechanical safety system for breaking the pyrotechnic chains during the presence of the missile on the carrier aircraft and protechnic safety boxes.

According to another feature of the invention, the frames, lower pallet and side flanks are in sandwich panel form constituted by a first lightweight alloy sheet and a second rigid composite material sheet between which is placed absorbent foam.

According to another feature of the invention, the lower pallet has numerous fixing points for holding and ejection means, constituted by fixing holes formed in the first sheet and in a composite material reinforcement.

Preferably, the side flanks are fixed to the upper flank by fixing bolts.

In a preferred construction of the container according to the invention, the window cutting means are pyrotechnic cords.

The invention is described in greater detail hereinafter relative to non-limitative embodiments and with reference to the attached drawings, wherein show:

Figure 1:
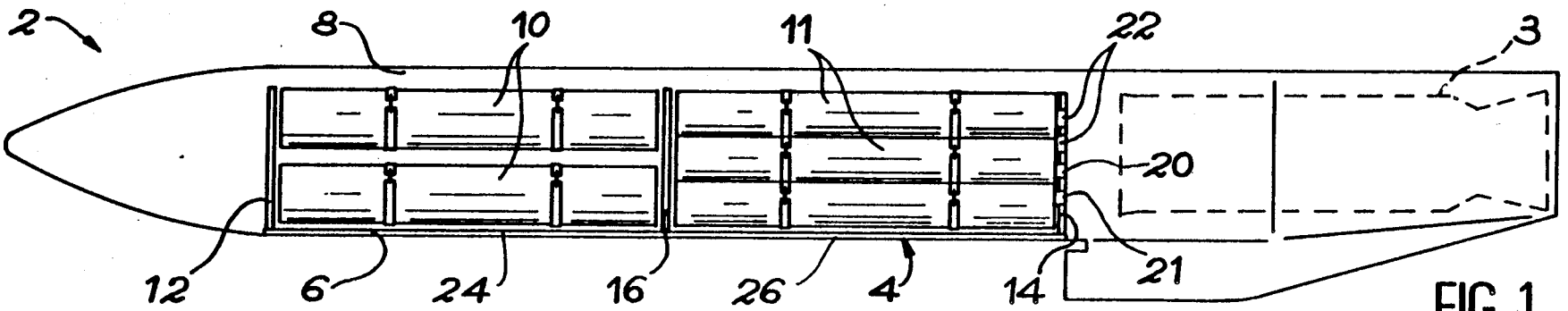
FIG. 1 is a side view of the missile according to the invention.

With reference to FIG. 1, the dropping or jettisoning missile 2 according to the invention essentially comprises motor means 3, in the present case a jet engine with suitable control and guidance means, and a container 4. The notion of the modifiable container is illustrated here by the ammunition or armaments 10 of the front container compartment 24, which differ from the ammunition or armaments 11 of the rear compartment 26 of the container 4. The prior art containers only carried one ammunition or armament type. These two, front 24 and rear 26, compartments of the container 4 are subdivided by an intermediate frame 16, the front and rear ends of the container 4 being defined by a front frame 12 and a rear frame 14. The different armaments 10 and 11 are held by holding and ejecting means, which will be described in greater detail hereinafter.

Figure 2B:
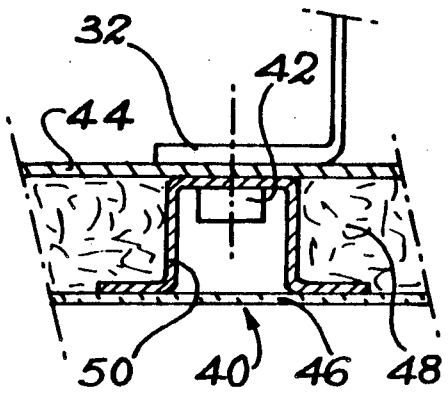
FIG. 2B is a partial cross-sectional view of the flanks of the missile.
Figure 2A:
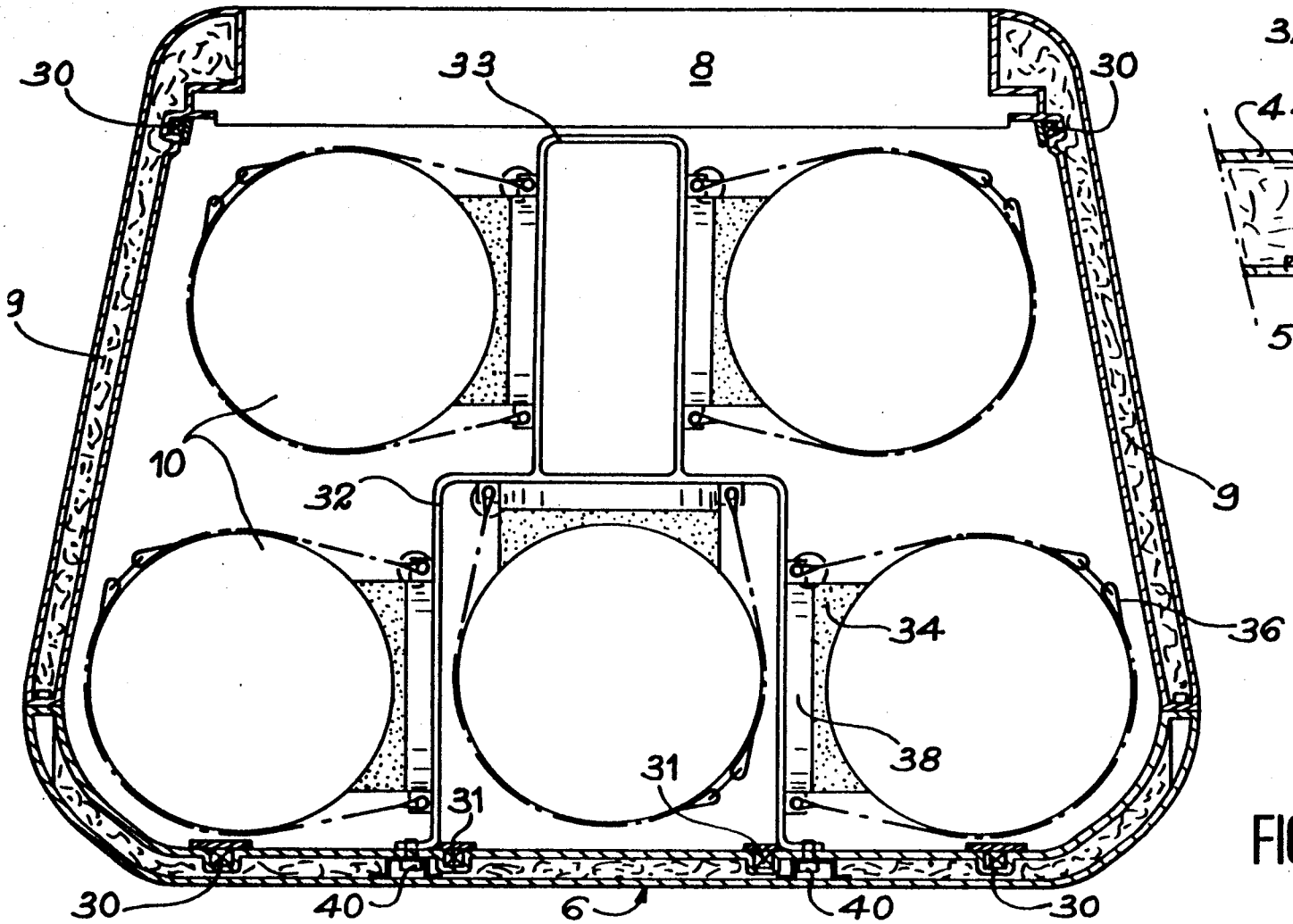
FIG. 2A is a cross-section through the missile according to the invention perpendicular to its axis.

FIG. 2A, which is a cross-section of the missile according to the invention, shows the lower pallet 6, the upper flank 8 and the five ammunition items 10 in the front compartment. The general structure of the modifiable container is completed by two side flanks 9. The reinforced upper flank 8 has a significant thickness. It constitutes a type of rigid beam ensuring a major part of the structural strength of the missile. The latter is completed by the fact that the side flanks 9 are rigidly fixed to said upper reinforced flank 8. They have lateral window cutting means constituted by pyrotechnic cords 30.

Before being assembled with the missile, the lower pallet 6 firstly receives the holding and ejecting means, together with the ammunition 10. The holding and ejecting means for the ammunition 10 are essentially constituted by support panniers 32,33 of different types. In each ammunition batch type, at least one support pannier 32 is fixed to the lower pallet 6. This first type of support pannier 32 contributes to the holding in place of the ammunition placed in the lower part of the container. The ammunition is held with the aid of setting blocks 34, each of which is fixed to a support pannier 32 or 33. The fixing of the ammunition 10 to the setting blocks 34 takes place by means of straps 36. Ejection is obtained with the aid of ejection bellows 38 containing inflatable bags. The operation of such ejection bellows is explained in greater detail hereinafter relative to FIGS. 3A and 3B. The second type of support pannier 33 is intended to hold in place ammunition 10 located in the upper part of the container. Therefore said second support pannier 33 is fixed to the first support 32. The support panniers 32 are made from lightweight alloy produced either by casting or mechanical welding. They are bolted to the lower pallet and to the frames.

In the case of FIG. 2A, five armaments 10 are shown. Their ejection from the container takes place through windows formed in the lateral flanks 9 and the lower pallet 6 by means of a first set of pyrotechnic cords 30. The four lateral armaments are laterally ejected by means of windows cut in the lateral flanks 9 and part of the lower pallet 6. The central armament, placed within the first support pannier 32 will be ejected through a window formed in the lower pallet 6 by means of a second set of cutting cords 31. Each setting block 34 and ejection bellows 38 is positioned with respect to the corresponding armament on the side opposite to the window through which the armament is to be ejected.

The lower pallet 6, the two lateral flanks 9 and their set of cutting cords 30,31 are of a standard nature, i.e. they all have the same shape and structure, no matter what type of ammunition or armament is carried. This also applies with respect to the end frames 12,14 in FIG. 1. Only the structure constituting the holding and ejection means mounted on the lower pallet 6 changes as a function of the ammunition to be carried. Thus, there are several different support pannier types, which can be easily assembled with one another and installed on the lower pallet 6. To this end, the latter has very numerous fixing points 40. This also applies with respect to the ejection and holding means, i.e. there are several different types of setting blocks 34, straps 36 and ejecting bellows 38.

This modifiable container design is obtained through the palletization of the ammunition batch to be carried. Thus, it is possible to form, as desired and at the last moment, a particular combination of several different ammunition types, as a function of the specific mission to be carried out. The number and different types of ammunitions are predetermined, so that the different holding and ejecting means for the same can then be installed on the lower pallet 6. Thus, the support panniers are chosen as a function of the ammunition type and as a function of the installation of said ammunition in the container, with a view to a particular use corresponding to the mission.

The rigid fixing of the side flanks 9 to the upper flank 8 can be carried out in different ways. In preferred manner it is brought about by fixing with bolts. The lower pallet 6 is fixed to the lateral flank 9 by screws on its periphery. It participates in the structural behaviour of the missile.

The fixing points 40 to the lower pallet 6 are shown in detail in FIG. 2B, which also shows the structure of the lower pallet 6 and the lateral flanks 9. All these elements, together with the frames, are constituted by a sandwich panel. The latter is formed by a first lightweight steel alloy sheet 44, a second rigid composite material sheet 46 and an absorbent foam 48 located between them. At the location chosen for a fixing point 40 for the ammunition holding and ejecting means, the foam 48 is replaced by an omega-shaped reinforcement 50 connecting the first sheet 44 to the second sheet 46. A bolt 42 passes through the thickness of the reinforcement 50 and the first sheet 44 and constitutes the fixing means for a support pannier 32.

Figure 3A:
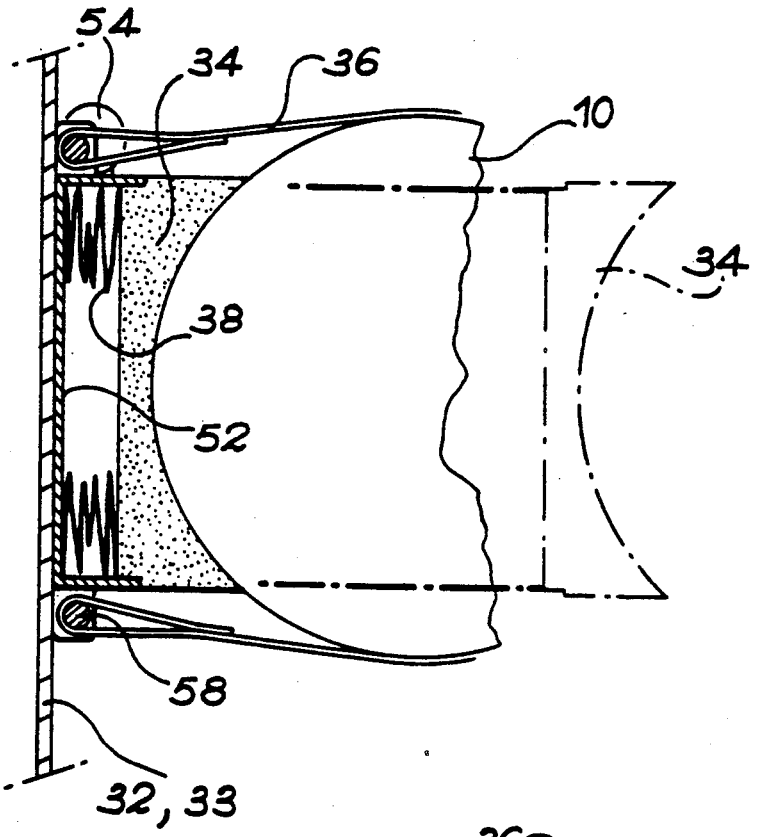
FIGS. 3A and 3B show the holding and ejecting means equipping the missile according to the invention.
Figure 3B:
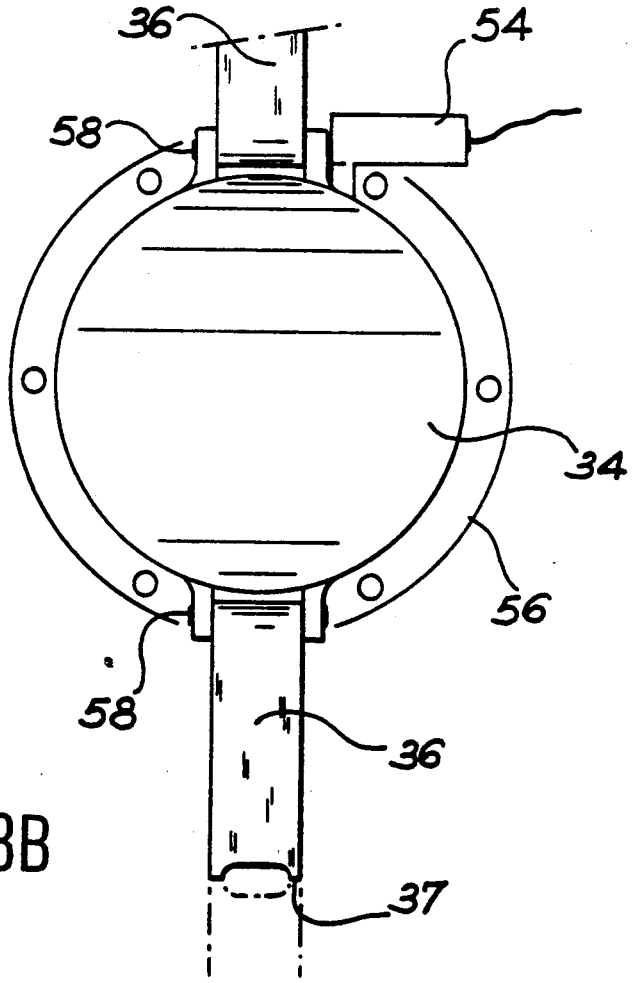

The holding and ejecting means are shown in FIGS. 3A and 3B. FIG. 3A explains the operation of the ejecting means and in particular the inflatable bag of the ejecting bellows 38. The latter has a first end rigidly fixed to a lightweight alloy structure 52, which is itself integral with the support pannier. The other end of the inflatable bag 38 is mobile and supports the setting block 34, which preferably is of rigid foam. When the gas generator 54 supplies gas to the inflatable bag 38, the latter inflates and expands pushing against the block 34, following the breaking of the strap 36. The block is then moved to the position shown in dot-dash lines with an acceleration adequate for ejecting the ammunition.

FIG. 3B shows a gas generator 54 issuing into a distribution ring 56. The latter surrounds the inflatable bag and the setting block 34 placed in the centre thereof. Handles 58 for fixing the holding straps 36 are integral with the support panniers and can be placed on said distribution ring 56. Each strap 36 has a reduced cross-section 37 where the strap 36 breaks when extended by the ammunition ejected.

Figure 4C:
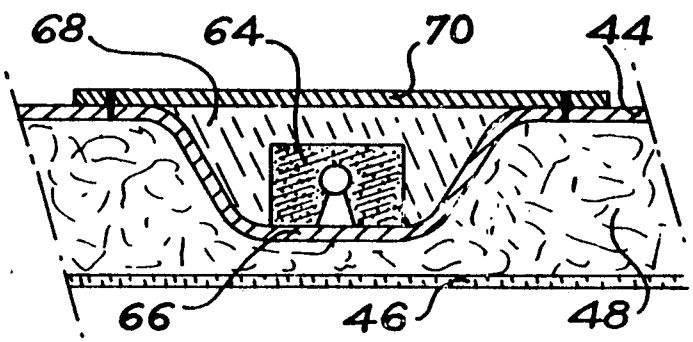
FIGS. 4A, 4B and 4C are explanatory diagrams relating to the formation of the ejection windows in the missiles according to the invention.
Figure 4A:
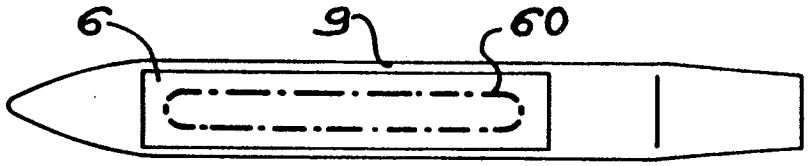

With reference to FIG. 4A, a lower window 60 is made in the lower pallet 6. The shape of said window corresponds to the profile of all the ammunition or armaments placed centrally and at the bottom of the container.

Figure 4B:
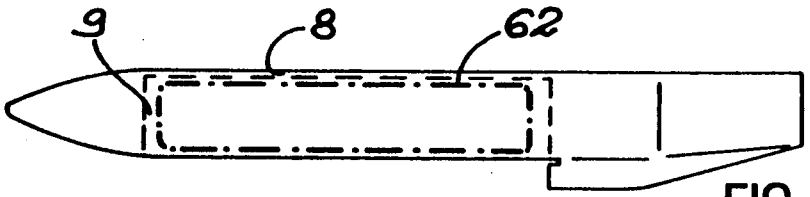

With reference to FIG. 4B, a lateral window 62 is made in a lateral flank 9 below the upper flank 8. In an identical way to the previous drawing, the shape of said lateral window 62 corresponds to the profile of all the ammunition having to be ejected through the corresponding side flank. These lateral and lower windows are obtained at the time of ejection with the aid of pyrotechnic cords defining, in mixed line form, the shapes of said two windows 60,62. The side windows 62 are astride the lower pallet 6 and the side flanks 9, so that two pyrotechnic cords are required for each window 62. However, for the lower window 60 only one pyrotechnic cord is required. The ignition or firing of the cords 64 is duplicated in order to increase their reliability.

With reference to FIG. 4C, said pyrotechnic cords 64 are installed against the inner sheet 66 and surrounded by silicone 68. This assembly is held in place by a longitudinal reinforcement 70.

All the intermediate or end frames are identical and are made by cast lightweight alloy, being bolted to the lower pallet. They also have the fixing points necessary for certain support panniers.

Returning to FIG. 1, the connection interface comprises a connector 20 for the electric power supply for the container 4 and a mechanical safety device 21 for the pyrotechnic chain of the container 4. Thus, when the latter is placed with the missile on an aircraft, the pyrotechnic chain must be broken. The connection interface also has pyrotechnic safety boxes 22 in connection with the firing of the cutting cords for the ejecting windows and for securing and firing the gas generators and ejection systems. It can also have an ammunition security and initialization box. The connector 20 and junction boxes 22 are placed on the rear frame 14 using known means.

With reference to FIGS. 5A, 5B, 5C and 5D, the ejection of the ammunition or armaments can take place in one or two stages, as a function of the ammunition type.

Figure 5A:
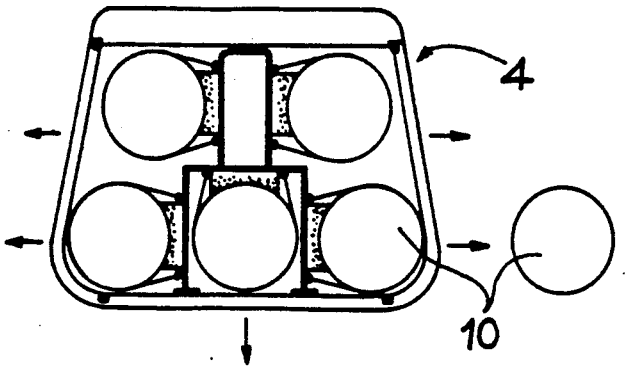
FIGS. 5A, 5B, 5C and 5D are cross-sections of the missile according to the invention in several filling versions for the container of the missile according to the invention.

FIG. 5A shows the arrangement described in FIG. 2 with five armaments of large diameter individually ejected by five ejection systems.

Figure 5B:
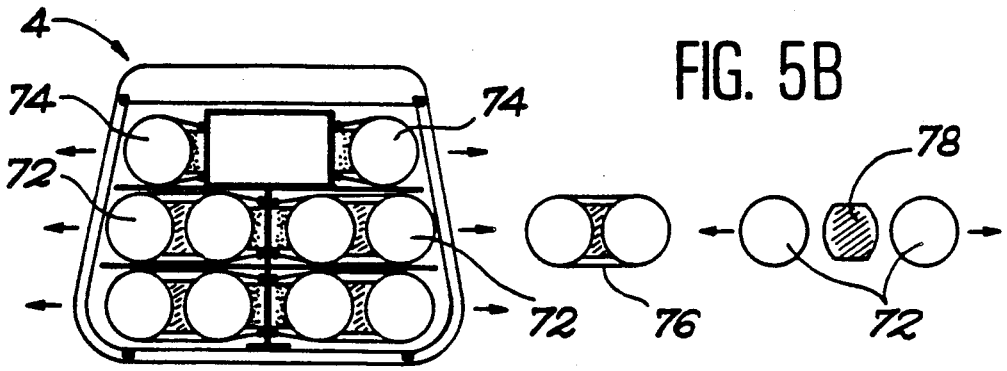

FIG. 5B shows a second possible arrangement for the container with ten smaller diameter armaments 72 arranged in a symmetrical manner. The upper armaments 74 are ejected individually. The armaments 72 placed below these upper armaments 74 are ejected in groups of two 76, each group 76 having its own ejection system 78 and this takes place in two stages. The right-hand part of FIG. 5B shows the second stage, where the two armaments 72 of group 76 are separated by their own ejection system 78.

Figure 5C:
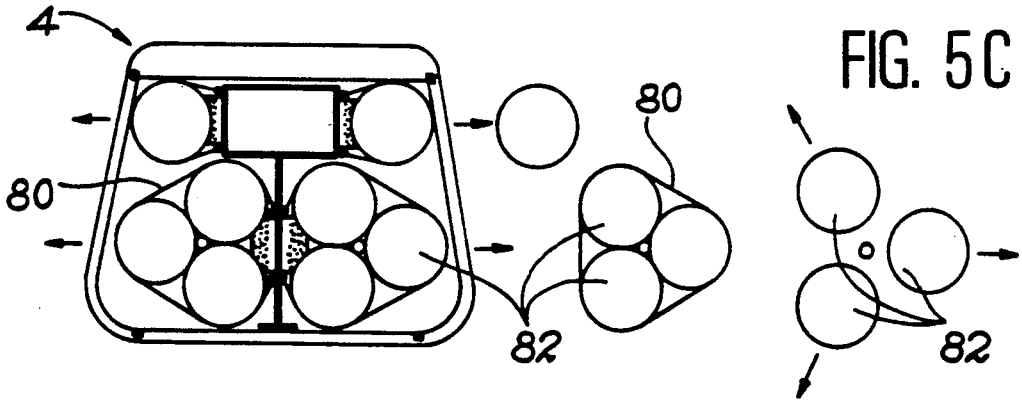

FIG. 5C shows a system identical to that of FIG. 5B, apart from the fact that the armament groups 80 consist of three armaments 82, separated in a second stage following the ejection of group 80.

Figure 5D:
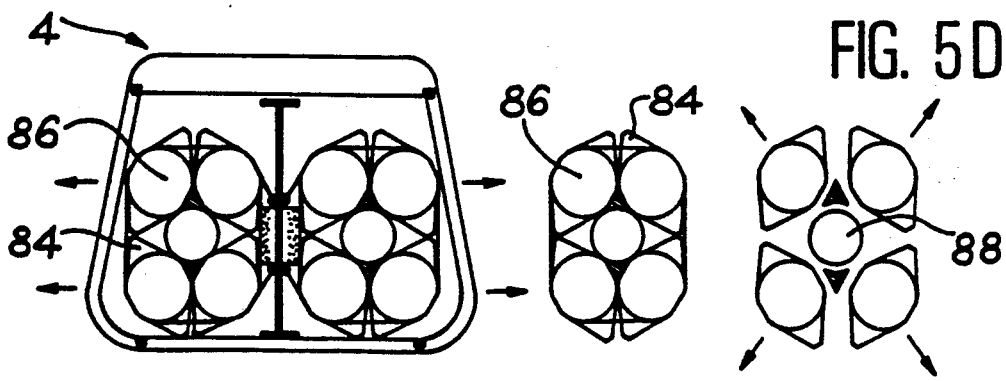

Finally, FIG. 5D shows a container with two armament groups 84 each having four armaments 86. These two groups 84 are firstly ejected from the container, each by its own ejection system. Once each group 84 has been ejected from the container 4, the armaments 86 are separated by their own ejection system 88.

The armaments or armament groups contained in the same pannier can be ejected at different speeds or velocities by adaptation of the pyrotechnic inflating charge of the ejection bags.

As is clear, the structure of the container according to the invention having identical items no matter what the ammunition or armament types used and standard elements means that the armament batch to be carried can be subdivided at random. Thus, once the mission has been established, the lower pallet can be equipped with holding and ejecting systems containing armaments chosen as a function of said mission. The assembly is then mounted on the missile beneath the upper flank and between the side flanks and everything is fixed by screwing.

We claim:

1. A missile for dropping a batch of armaments comprising a housing, propulsion means and guidance and control means in said housing, a container having means located therein for holding and ejecting at least one armament group, said container comprising an upper, reinforced flank, two side flanks integral with the upper flank with each having means for cutting windows therein, a lower pallet integral with the two side flanks and having means for cutting a window therein, and two end frames, said holding and ejecting means being supported by said lower pallet, and connecting means on one end frame for conecting the container to the housing to form the missile.

2. The missile of claim 1, including at least one intermediate frame subdividing the container into at least two compartments, each compartment having separate holding and ejecting means.

3. The missile of claim 1, wherein the holding and ejecting means comprises support panniers fixed to the lower pallet, setting blocks and straps for holding the armaments and pyrotechnically controlled bellows for ejecting the armaments.

4. The missile of claim 1, wherein the means for cutting the windows comprises pyrotechnic cords.

5. The missile of claim 4, wherein the means for connecting the container to said housing includes a connector for supplying electric power to the pyrotechnic cords, and a mechanical safety means for breaking the electrical connection during the presence of the missile on a carrier vehicle.

6. The missile of claim 1, wherein the lower pallet and the side flanks of the container are formed by sandwich panels comprising a first lightweight steel alloy sheet and a second rigid composite material sheet, between which is placed an absorbent foam.

7. The missile of claim 1, wherein the lower pallet has a plurality of holes for securing the holding and ejecting means thereto at various locations.

8. The missile of claim 1, wherein the side flanks are fixed to the upper flank by bolts.

9. The missile of claim 1, wherein the lower pallet is fixed to the side flanks by screws.

* * * * *

UNITED STATES PATENT AND TRADEMARK OFFICE

CERTIFICATE OF CORRECTION

PATENT NO. : 5,094,170

DATED : March 10, 1992

INVENTOR(S) : Jacques Raynaud et al.

It is certified that error appears in the above-identified patent and that said Letters Patent is hereby corrected as shown below:

On the title page:

[75] Inventors: Add Roger Chantome, Paris

Signed and Sealed this

Nineteenth Day of January, 1993

*Attest:*

DOUGLAS B. COMER

*Attesting Officer*

*Acting Commissioner of Patents and Trademarks*